US006658875B2

(12) United States Patent
Weng

(10) Patent No.: US 6,658,875 B2
(45) Date of Patent: Dec. 9, 2003

(54) METHOD AND APPARATUS FOR TEMPERATURE CONTROL IN A REFRIGERATION DEVICE

(75) Inventor: Chuan Weng, Weaverville, NC (US)

(73) Assignee: GSLE Development Corporation, Charlotte, NC (US)

( * ) Notice: Subject to any disclaimer, the term of this patent is extended or adjusted under 35 U.S.C. 154(b) by 29 days.

(21) Appl. No.: 09/841,051

(22) Filed: Apr. 25, 2001

(65) Prior Publication Data

US 2002/0157407 A1 Oct. 31, 2002

(51) Int. Cl.[7] ..... F25B 41/04
(52) U.S. Cl. ..... 62/196.4; 62/228.3
(58) Field of Search ..... 62/196.4, 159, 62/160, 196.1, 228.3, 229, 203

(56) References Cited

U.S. PATENT DOCUMENTS 3,110,160 A * 11/1963 Miner ..... 62/228.3 X
3,933,004 A * 1/1976 Carter et al. ..... 62/196.4 X
4,240,266 A * 12/1980 Scrine et al. ..... 62/196.4
6,058,728 A * 5/2000 Takano et al. ..... 62/196.4
6,311,505 B1 * 11/2001 Takano et al. ..... 62/196.4 X

* cited by examiner

*Primary Examiner*—Harry B. Tanner
(74) *Attorney, Agent, or Firm*—Baker & Hostetler LLp

(57) ABSTRACT

A temperature control device including a temperature sensor which senses a temperature at a specified location within the refrigeration apparatus. The temperature control device has first flow valve that is operable to selectively increase or decrease the flow of refrigerant in response to the temperature sensed by the sensor. In addition, the device has a second flow valve that is operable to selectively increase or decrease hot gas flow in response to the temperature sensed by the sensor. The temperature control device also contains a controller which controls the above mentioned valves in response to the temperature sensed by the temperature sensor.

14 Claims, 2 Drawing Sheets

METHOD AND APPARATUS FOR TEMPERATURE CONTROL IN A REFRIGERATION DEVICE

FIELD OF THE INVENTION

The present invention relates generally to temperature control in a refrigeration device. More particularly, the present invention relates to a back-up temperature control mechanism that allows a refrigerator or incubator to remain within a preset temperature range should the primary temperature control mechanism fail.

BACKGROUND OF THE INVENTION

Electronic control packages have been developed for providing precise temperature control in refrigeration equipment including, e.g., ultra low freezers, incubators, and walk-in freezers. In refrigeration equipment, particularly in laboratory refrigeration equipment, the desire is to accurately maintain the temperature within the chamber below a desired set point. The selected set point would ordinarily be selected as the temperature necessary to preserve test samples from degradation. In refrigeration equipment, cooling is performed by absorbing heat within an enclosed chamber into a cooled refrigerant gas and transferring that heat into ambient air outside of the refrigeration device.

Similarly, incubators also exchange heat within a chamber to outside ambient air utilizing the same methods. Unlike refrigeration equipment, which operates to keep the chamber below a set point temperature, incubators must maintain the temperatures between lower and upper set point temperatures. While refrigeration equipment is typically used to preserve items placed in the chamber, incubators are used to conduct experiments in controlled temperature environments.

Thus, while refrigeration equipment only requires apparatus for cooling the inner chamber relative to ambient air temperature, an incubator must be able to both cool and heat the chamber to remain within the desired temperature range. In order to maintain highly precise temperature control in the foregoing devices, microprocessor control devices have been employed and are now standard on laboratory equipment.

While an electronic component on these controllers only fails occasionally, the damage an end-user of the refrigerator can suffer from such failure can be quite severe because products stored or being tested in the refrigeration equipment can be damaged or the tests compromised. Thus, the effects can be devastating when an electronic component fails, subjecting the stored products to unintended temperature conditions.

There is therefore a need for a temperature control mechanism which allows for backup control when a primary controller fails. More particularly, there is a need for a mechanism for refrigeration equipment to cycle within an acceptable temperature range automatically on failure of the primary temperature control thereby reducing the chances of property loss if the primary controller fails.

SUMMARY OF THE INVENTION

The foregoing needs are met, to a great extent, by the present invention where, in one aspect, a temperature control device is provided having a temperature sensor which senses temperature at a specified location within the refrigeration apparatus. The temperature control device has a first flow valve that is operable to selectively increase or decrease the flow of refrigerant in response to the temperature sensed by the sensor. In addition, the device has a second flow valve that is operable to selectively increase or decrease hot gas flow in response to the temperature sensed by the sensor. The temperature control device also contains a controller which controls the above mentioned valves in response to the temperature sensed by the temperature sensor.

In accordance with another aspect of the invention, the device includes a means for sensing a temperature at certain location of an incubation system. The device has a means for increasing or decreasing refrigerant flow in a first flow path in response to the temperature sensed by the sensing means. In addition, the device provides a means for increasing or decreasing hot gas flow in a second flow path in response to the temperature sensed by the sensing means. The device also provides a means for controlling the valves in response to the temperature in response to the temperature sensed by the sensing means.

In accordance with yet another aspect of the present invention, a method for providing back-up temperature control is provided by first maintaining the temperature inside a chamber within a selected range utilizing a first controller. Second, back-up temperature control is provided by sensing the temperature inside a chamber by utilizing a second temperature controller. Third, back-up temperature control is provided by measuring the the time duration after the compressor cycles on and a first valve is open. Fourth, back-up temperature control is provided by turning the first valve off after a predetermined time has passed and turning a second valve on. And finally, back-up temperature control is provided by cycling the compressor off when the temperature in the chamber is outside the selected range of the first controller and reaches a minimum temperature set point of the second temperature controller.

There has thus been outlined, rather broadly, the more important features of the invention in order that the detailed description thereof that follows may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
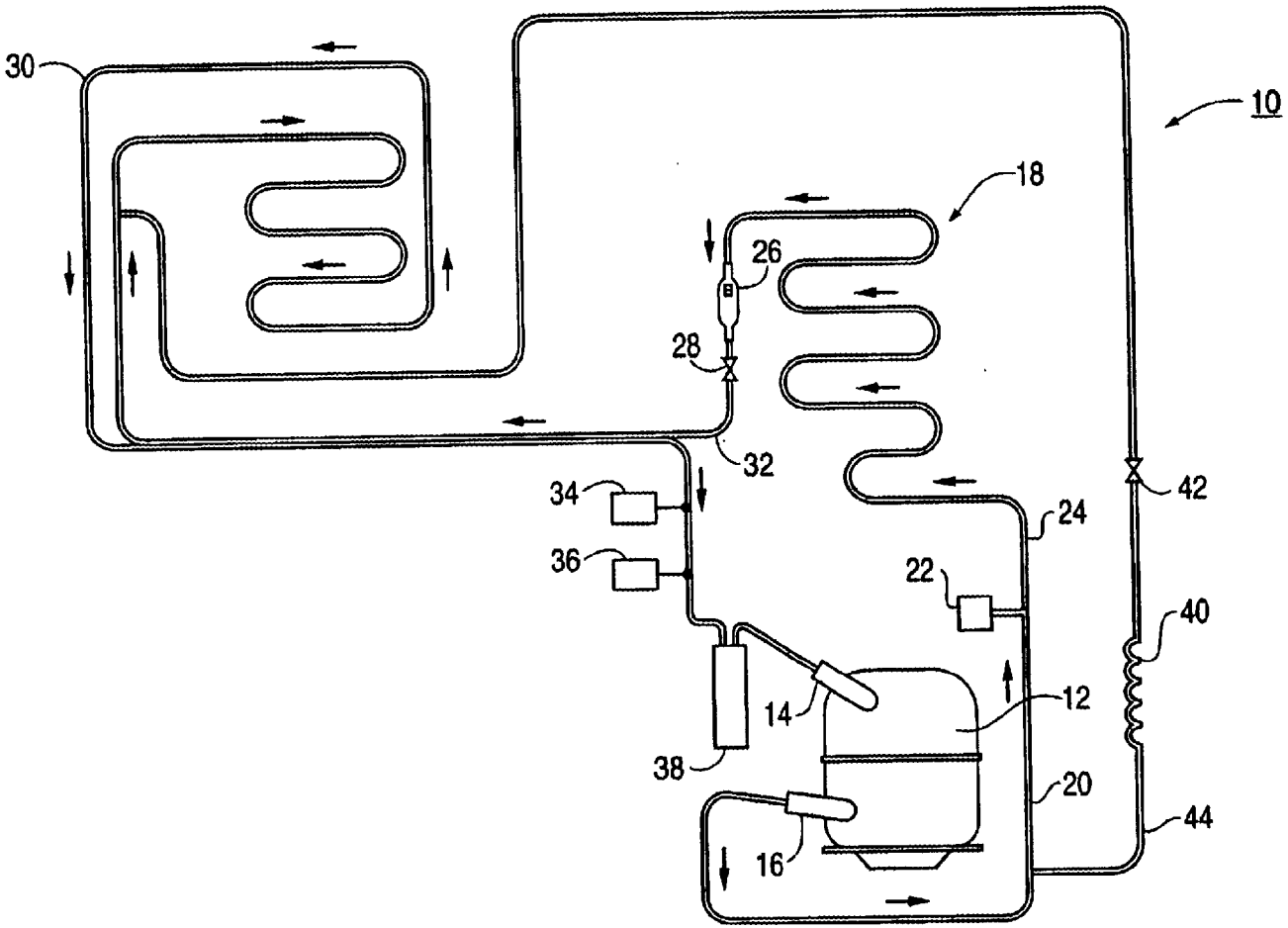
FIG. 1 is a schematic diagram of a single compressor refrigeration apparatus incorporating the temperature control mechanism of the present invention.
Figure 2:
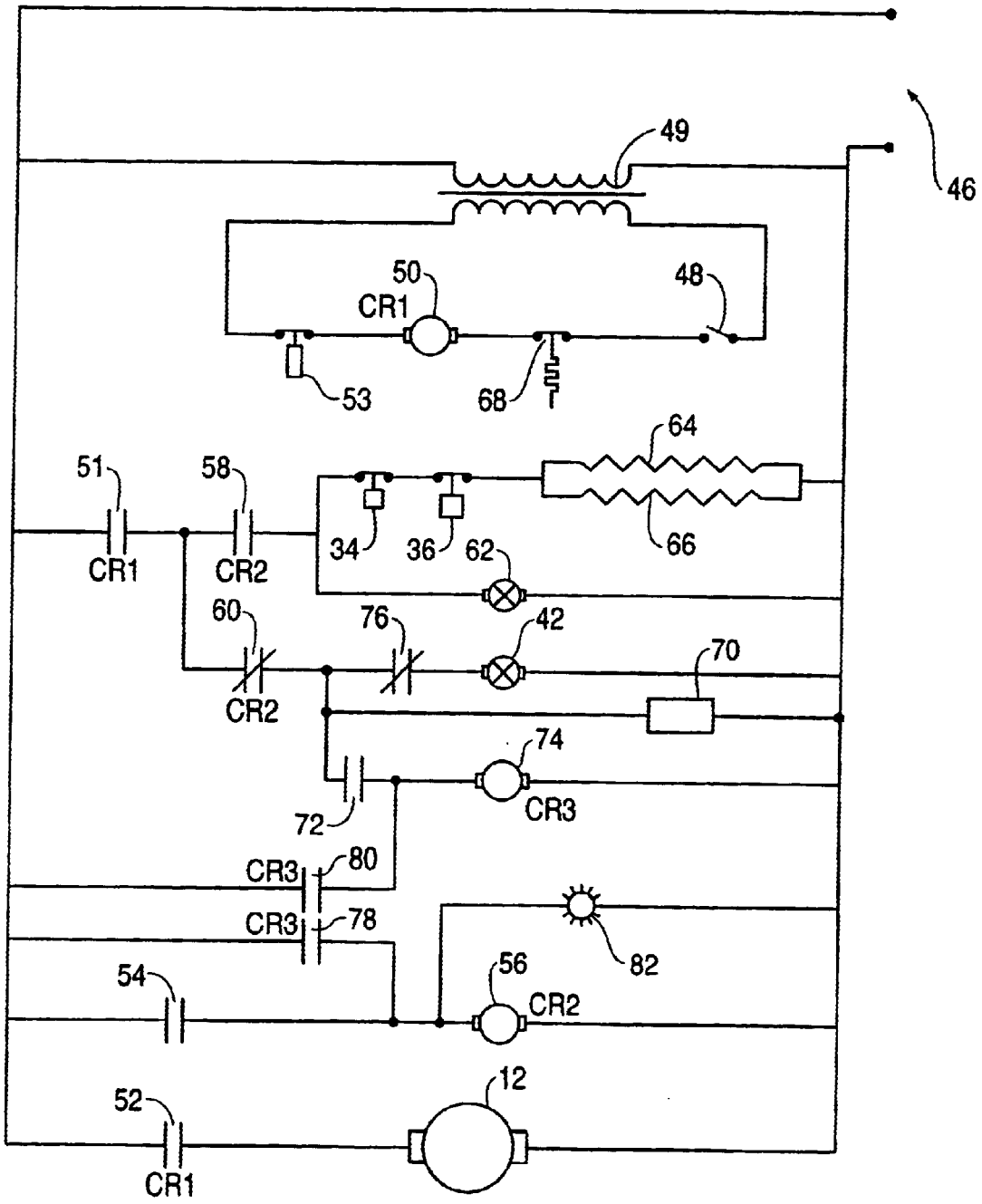
FIG. 2 is an electrical schematic diagram of the refrigeration apparatus of FIG. 1.

Referring now to the figures wherein like reference numerals indicate like elements, FIGS. 1 and 2 illustrate the presently preferred embodiment of a refrigeration apparatus 10 with the temperature control mechanism of the present invention. While in the embodiment depicted the refrigeration system is an incubator, it should be understood that the present invention is not limited in its application to incubators.

Operation of the temperature control mechanism can be understood by reference first to the mechanical aspects of the system as shown in FIG. 1 and then by reference to the electrical aspects of the system as shown in FIG. 2. In the refrigeration apparatus 10 of FIG. 1, during normal cooling operation a compressor 12 draws in low pressure vapor refrigerant to the compressor 12 through an inlet fitting 14 and releases compressed, high pressure vapor refrigerant from the compressor 12 through an outlet fitting 16. In this mode, the compressor 12 compresses the incoming, low pressure vapor refrigerant into a high pressure vapor refrigerant and delivers the refrigerant to the condenser coils 18. The refrigerant is pumped from the compressor 12 via a conduit 20 or tubing through a high pressure cutout valve 22. A discharge fitting 24 for removing refrigerant from the system is provided in the conduit 20.

Upon exiting the compressor 12, the temperature of the high pressure vapor refrigerant is elevated in comparison to the environment surrounding the condenser coils 18. As the refrigerant is fed through the condenser coils 18, heat from the refrigerant is transferred to the surrounding environment, cooling the high pressure vapor refrigerant condensing all or part of the vapor refrigerant. This heat transfer may be enhanced by forcing air over the condenser 18 or by encasing the condenser coils 18 in a cooling bath. The refrigerant flows out of the condenser 18 and through a drier 26 where water is removed from the refrigerant and the aforementioned liquid/gas refrigerant is passed to an electrically operated liquid solenoid valve 28. The solenoid valve 28 restricts flow thereby reducing the pressure of the refrigerant. Solenoid valve 28 is normally open allowing the refrigerant to flow into the evaporator coils 30. The solenoid valve 28 is a flow control mechanism operable to selectively increase or decrease refrigerant flow in response to the temperature sensed by a sensor. A discharge fitting 32 is provided in the evaporator coil line to permit adding or removing refrigerant from the system.

When the refrigerant flows into the evaporator 30, the pressure of the refrigerant has decreased and, consequently, the temperature also has decreased. The evaporator coils 30 are arranged in conjunction with the chamber in which temperature is being controlled to permit the flow of low temperature refrigerant to absorb heat from the chamber. The expanded mixture exits the evaporator 30 and passes through a low pressure control 34 and high pressure control 36 and enters the accumulator 38. As the mixture exits the high pressure control 36, it enters the accumulator 38 where residual liquid refrigerant is deposited in the base of the accumulator 38 while the gas is drawn into the compressor 12 through the inlet 14.

The low pressure control 34 and high pressure control 36 are attached to the suction side of the refrigeration system and are safety features that aid in the regulation of air discharge temperature of the evaporator 30. In the event of a loss of refrigerant resulting in the decrease of suction pressure to 5 psi, the low pressure control 34 will shut off portions of the system, as described below, to reduce the chance of overheating the incubator interior due to lack of refrigeration capacity. The high pressure control 36 shuts off portions of the system in the event the static pressure within the refrigeration system exceeds 100 psi.

During initial system start-up, the chamber in which temperature is being controlled is usually warmer than the control set point and the heat load on the unit 10 is large. A temperature sensor provides the evaporator temperature to the temperature control mechanism. An evaporator temperature warmer than that selected by the operator results in a signal to open solenoid valve 28. When the temperature in the chamber becomes cooler than the temperature set by the operator, the solenoid valve 28 closes to stop flow of refrigerant into the evaporator 30 while the control operates solenoid valve 42, enabling hot gas to flow directly from the compressor 12 through discharge conduit 44 into the evaporator 30.

In the heating mode, high pressure, elevated temperature vapor refrigerant passes through a capillary tube coil 40, to the solenoid valve 42 located on the hot gas conduit 44. In operation, the solenoid valve 28, located downstream of the drier 26, is closed when the valve 42 is open. As a result, the hot refrigerant flows through the capillary tube 40 where the liquid refrigerant is partially cooled forming a liquid/gas mixture. The warm liquid/gas mixture enters and travels through the evaporator coils 30, warming the chamber. The alternating of the heating and refrigerating processes provides a more steady and controllable temperature profile in the evaporator 30, therefore yielding a matching air temperature range inside the refrigeration chamber.

Different types of control devices may be employed for regulating the temperature in the cooling or incubation chamber. In the preferred embodiment, two control systems are provided for operating the refrigeration apparatus. The primary temperature control system is preferably the Intr-Logic™ electronic control system provided by Revco Technologies of Asheville, N.C. This electronic temperature control system allows the operator to freely change the control set point within a 0.1° C. increment.

Linked by the original on/off control relay for the condensing and compressor unit, the second temperature control unit provides the control for the alternation of refrigerating and heating processes. When a malfunction occurs in the primary temperature control, mechanical thermostat 68 (shown in FIG. 2) serves as a back up device to maintain the temperature of the chamber in an acceptable range. Preferably the mechanical thermostat 68 is housed in a separate electrical junction box mounted on top of the refrigerator or incubator.

FIG. 2 is a schematic diagram of the electronics of the temperature control mechanism of the system of FIG. 1. The operating procedure for the control system starts by plugging in the power cord 46 into a standard 20 amp, 115 VAC dedicated power supply or otherwise providing power to the device. The power proceeds to flow through a step down transformer 49 resulting in a 24 VAC power supply and onto the manual reset switch 53. When the chamber temperature is warmer than the control set point, turning the control switch 48 to the "on" position, the CR1 relay 50 is energized closing the CR1 switches 51, 52 energizing the compressor 12. The apparatus 10 is now in refrigerating mode.

Turning the main switch 48 to the "on" position also causes the micro contact 54 to close energizing the CR2 relay 56. The CR2 relay 56 has a normally open contact 58 and a normally closed contact 60. Upon being energized, the CR2 relay 56 opens the normally closed CR2 contact 60 and closes the normally open CR2 contact 58. As a result, the liquid solenoid valve 62 and heaters 64, 66 are prepared for the refrigerating mode while solenoid valve 42 is closed, shutting off the hot gas by-pass. It is noted that the heaters 64, 66 are on during the refrigeration mode to prevent overcooling.

A mechanical thermostat 68 is provided to enable the refrigeration apparatus 10 (FIG. 1) to continue cycling if the micro contact 54 fails in the open or closed position due to electronic malfunction. If the micro contact 54 fails in the closed position, energizing the CR2 relay 56 continuously, the system would be in constant refrigeration mode possibly damaging the products stored in the chamber. When the refrigeration chamber lowers to a preselected temperature set point, preferably 33° F., the mechanical thermostat 68 opens, de-energizing the CR1 relay 50, opening the CR1 relay switches 51, 52, disconnecting the compressor unit 12, and stopping the flow of refrigerant through the apparatus 10. When the temperature in the chamber increases to a preselected temperature set point, preferably 37° F., the mechanical thermostat 68 closes the CR1 switch 52 energizing the compressor 12 and returning the apparatus 10 to the refrigeration mode.

If the micro contact 54 fails in the open position, the CR2 relay 56 remains disconnected from power causing the normally open CR2 switch 58 to stay in the open position while the normally closed CR2 switch 60 remains in the closed position. This causes the solenoid valve 42 to be energized resulting in a constant heating mode. In this mode the timer 70 is energized and, in a preferred embodiment, counts for nine minutes and, after the ninth minute, the timer closes a switch 72 providing power to the CR3 relay 74. A normally closed switch 76 in the circuit of the hot gas solenoid valve 42 opens, opening the valve. The CR3 relay 74 closes switches 78, 80 by-passing the failed micro contact 54 causing the CR3 relay 74 and the CR2 relay 56 to remain energized, placing the apparatus 10 back in the refrigeration mode. Once the temperature in the chamber cools to 33° F., the mechanical thermostat 68 opens, de-energizing the CR1 relay 50, opening switches 51, 52.

As a warning to the operator that, while functioning, the apparatus is not operating in normal mode if the micro contact 52 fails, open or closed, the signal light 82 will be illuminated continuously, alerting the operator as to the type of failure.

The above description and drawings are only illustrative of preferred embodiments which achieve the objects, features, and advantages of the present invention, and is not intended that the present invention be limited thereto. Any modification of the present invention which comes within the spirit and scope of the following claims is considered to be part of the present invention.

What is claimed is:

1. A temperature control device comprising:

a temperature sensor operable to sense a temperature at a certain location of said device;

a first flow valve operable to selectively increase or decrease refrigerant flow in a first flow path;

a second flow valve operable to selectively increase or decrease hot gas flow in a second flow path;

a primary controller that controls the first and second flow valves in response to the temperature sensed by the temperature sensor; and a secondary controller operable to control the first and second flow valves in response to the temperature sensed by the temperature sensor.

2. The temperature control device according to claim 1, wherein the controller opens the first valve and closes the second valve when the sensed temperature is greater than a predetermined value.

3. The temperature control device according to claim 1, wherein the controller closes the first valve and opens the second valve when the sensed temperature is less than a predetermined value.

4. The temperature control device according to claim 1, wherein said first flow path comprises a compressor, a condenser and an evaporator.

5. The temperature control device according to claim 4, wherein said second flow path comprises said compressor and said evaporator.

6. The temperature control device according to claim 1, wherein said second flow path comprises a compressor and an evaporator.

7. The temperature control device according to claim 6, further comprising a capillary tube connected to said compressor wherein refrigerant from the compressor is cooled.

8. The temperature control device according to claim 1, wherein the primary controller is a primary thermostat.

9. The temperature control device according to claim 1, wherein the secondary controller is a secondary thermostat.

10. The temperature control device according to claim 1, wherein the secondary controller is activated to control the first and second flow valves when a malfunction occurs in the primary controller.

11. A system for controlling temperature, comprising:

means for sensing a temperature at a certain location of an incubation system;

means for increasing or decreasing refrigerant flow in a first flow path in response to the temperature sensed by the sensing means;

means for increasing or decreasing hot gas flow in a second flow path in response to the temperature sensed by the sensing means;

primary means for controlling the valves in response to the temperature sensed by the temperature sensing means; and secondary means for controlling the valves in response to the temperature sensed by the temperature sensing means.

12. A system according to claim 11, wherein the primary means for controlling the valves opens a first flow valve and closes a second flow valve when the sensed temperature is greater than a predetermined valve.

13. A system according to claim 11, wherein the primary means for controlling:

regulates the air discharge temperature of said evaporator with a low pressure sensor by shutting down portions of the system and further regulates the air discharge temperature of said evaporator with a high pressure sensor by shutting down portions of the system.

14. The system according to claim 11, wherein the secondary means for controlling the valves is activated when a malfunction occurs in the primary means for controlling the valves.

* * * * *